US009366062B2

(12) United States Patent
Kerr, III

(10) Patent No.: US 9,366,062 B2
(45) Date of Patent: Jun. 14, 2016

(54) VEHICLE DOOR LOCK ACTUATION PREVENTION APPARATUS

(71) Applicant: Toyota Motor Engineering & Manufacturing North America, Inc., Erlanger, KY (US)

(72) Inventor: Norman Charles Kerr, III, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 232 days.

(21) Appl. No.: 14/020,901

(22) Filed: Sep. 9, 2013

(65) Prior Publication Data

US 2015/0069764 A1 Mar. 12, 2015

(51) Int. Cl.

| | |
|---|---|
| ***E05C 1/06*** | (2006.01) |
| ***E05B 85/16*** | (2014.01) |
| ***E05B 77/06*** | (2014.01) |

(52) U.S. Cl.

CPC ..... *E05B 85/16* (2013.01); *E05B 77/06* (2013.01); *Y10T 292/1015* (2015.04); *Y10T 292/57* (2015.04)

(58) Field of Classification Search

CPC ..... E05B 85/16; E05B 77/06; E05B 79/06; E05B 77/04; E05B 77/12; E05B 77/34; E05B 85/18; E05B 79/12; E05B 83/36; E05B 1/04; E05B 7/00; Y10T 16/466; Y10S 292/22; E05C 1/14

USPC ..... 292/139, 336.3

See application file for complete search history.

(56) References Cited

U.S. PATENT DOCUMENTS

| | | | | |
|---|---|---|---|---|
| 5,676,002 | A * | 10/1997 | Hoeptner, III | 70/416 |
| 6,237,987 | B1 | 5/2001 | Babatz et al. | |
| 7,152,893 | B2 | 12/2006 | Pudney | |
| 2011/0095546 | A1 | 4/2011 | Russell et al. | |
| 2012/0119519 | A1 * | 5/2012 | Sakai et al. | 292/92 |

* cited by examiner

*Primary Examiner* — Mark Williams

(74) *Attorney, Agent, or Firm* — Christopher G. Darrow; Darrow Mustafa PC

(57) ABSTRACT

A vehicle door opening prevention apparatus includes a thin cross-section spacer or flange coupled to a plate attached to a door handle frame in a vehicle door's door handle assembly. One end of the flange is positioned relative to a door lock assembly mounted within the vehicle door to limit the maximum amount of lateral inward movement of the door handle assembly toward the door lock assembly during lateral forces exerted on the vehicle door to prevent movement of an actuator pin to a door lock assembly unlatch position via movement of a fork coupled to a handle and engaged with the actuator pin.

9 Claims, 7 Drawing Sheets

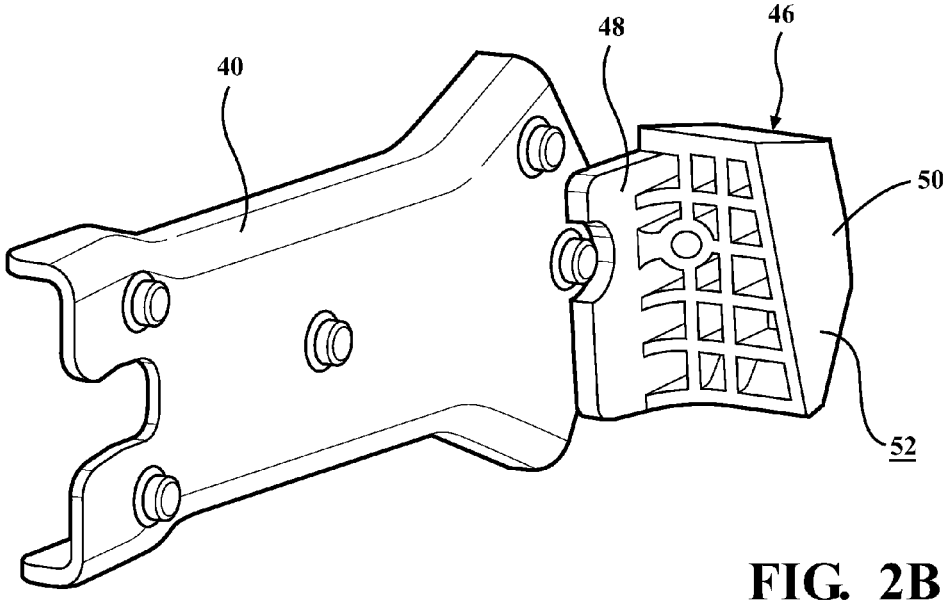
FIG. 2B
PRIOR ART
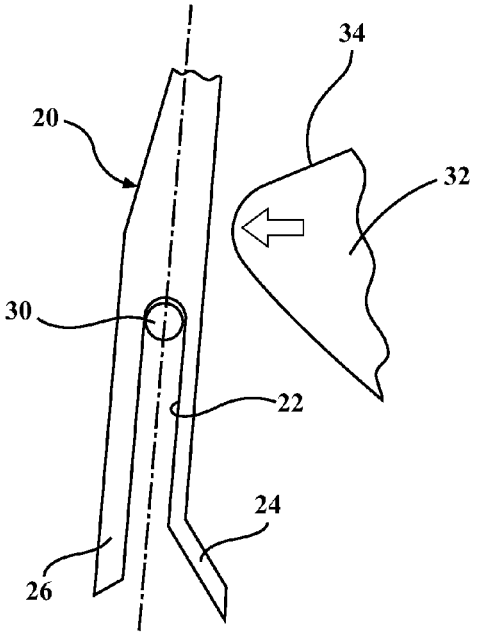
FIG. 4A
FIG. 4B
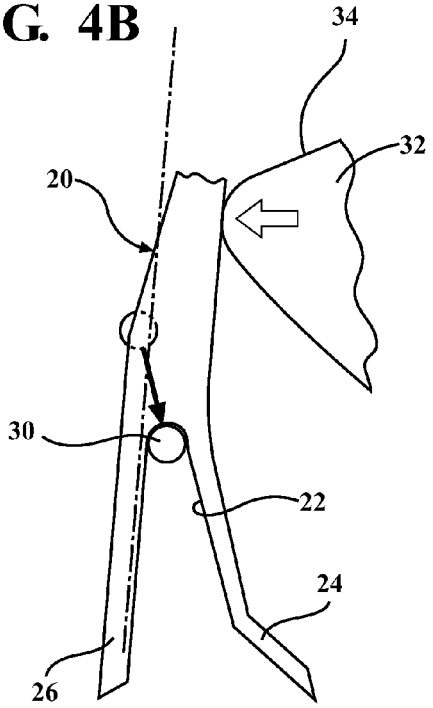

VEHICLE DOOR LOCK ACTUATION PREVENTION APPARATUS

BACKGROUND

The present description relates, in general, to vehicle doors and their door lock assemblies and, more particularly, to an apparatus for preventing actuation of a door lock assembly during a side impact collision.

Vehicle doors include an outside mounted pivotal handle, which can be moved in a direction to open a vehicle door. A cable or link couples the handle to a door lock assembly so that movement of the handle in an opening direction causes the cable or link to actuate the door lock assembly to unlatch the door lock assembly and enable the vehicle door to be opened.

Governmental safety standards have requirements for door lock assembly performance upon forces applied to the vehicle door, such as during a side impact collision. While various mechanisms have been employed to prevent accidental actuation and unlatching of the door lock assembly causing opening of the vehicle door during a side impact collision, such mechanisms cannot be employed in all vehicle door configurations due to size constraints.

SUMMARY

A vehicle door opening prevention apparatus for a door handle assembly mounted in an outer door panel, with a movable handle accessible exteriorly of the outer door panel. A link or fork is coupled to the handle and is movable with the handle when the handle moves to a door opening position to engage an actuator pin on a door lock assembly carried by the vehicle door to move the actuator pin in a direction to actuate and unlatch the door lock assembly. A spacer or flange can be carried on a plate coupled to the door handle assembly extending in a direction toward the door lock assembly to prevent movement of the door handle assembly upon lateral forces exerted on the vehicle door, such as during a side impact collision, sufficiently to move the fork in a direction to actuate the door lock assembly, unlatch the door lock assembly, and allow the vehicle door to open.

The flange can be integrally formed with the plate. The flange extends angularly from, and can be substantially perpendicular to, the plate. The flange has substantially the same thin cross-sectional thickness as the plate.

In another aspect, a door handle apparatus is disclosed for a vehicle door having a door lock assembly for latching and unlatching the vehicle door. The door handle apparatus includes a door handle assembly mounted in an outer door panel of the vehicle door, and carries a movable handle accessible exteriorly of the vehicle door. The handle is movable relative to the vehicle door to a position to open the vehicle door. A door lock assembly carried on the vehicle door includes an actuator pin movable from a first position in which the door lock assembly is latched to a second position in which the door lock assembly is actuated and unlatched to allow opening of the vehicle door. A fork is coupled to the handle and engaged with the actuator pin for moving the actuator pin to the second position to unlatch the vehicle door when the handle is moved away from the vehicle door. A door operation prevention apparatus is provided on the handle and includes a plate mounted on the door handle assembly and a spacer carried on the plate extending toward the door lock assembly within the vehicle door to prevent movement of the door handle assembly toward the door lock assembly upon lateral forces exerted on the vehicle door, such as during a side impact collision, a sufficient distance which would cause the fork to move the actuator pin to the second position.

In another aspect, a vehicle door includes an outer door panel joined to an inner door panel. A handle frame is mounted in the outer door panel and includes a movable handle. A door lock assembly is mounted to the inner door panel. An actuator pin is coupled to the door lock assembly and is movable from a first position corresponding to a latched condition of the door lock assembly and a second position in which the actuator pin unlatches the door lock assembly to allow opening of the vehicle door when the handle is moved relative to the handle frame. A fork carried by the handle is engageable with the actuator pin to move the actuator pin to the second unlatched position when the handle is moved relative to the vehicle door. A spacer carried on a plate coupled to the handle frame is angularly disposed between the door lock assembly and the plate to limit movement of the handle frame toward the door lock assembly upon lateral forces exerted on the vehicle door, such as during a side impact collision, to prevent movement of the actuator pin to the second position thereby preventing unlatching of the door lock assembly.

BRIEF DESCRIPTION OF THE DRAWING

The various features, advantages and other uses of the present invention will become more apparent by referring to the following detail description and drawing in which:

FIG. 2B is a partial, left hand perspective view of the plate and the prior art spacer shown in FIG. 2A;

FIG. 4A is a pictorial representation of a lateral force approaching the fork, also showing an actuator pin moveable by the fork to actuate and unlatch a door lock assembly;

FIG. 4B is a pictorial representation of the lateral force acting on the fork to actuate and unlatch a door lock assembly by moving the actuator pin;

DETAILED DESCRIPTION

Figure 2A:
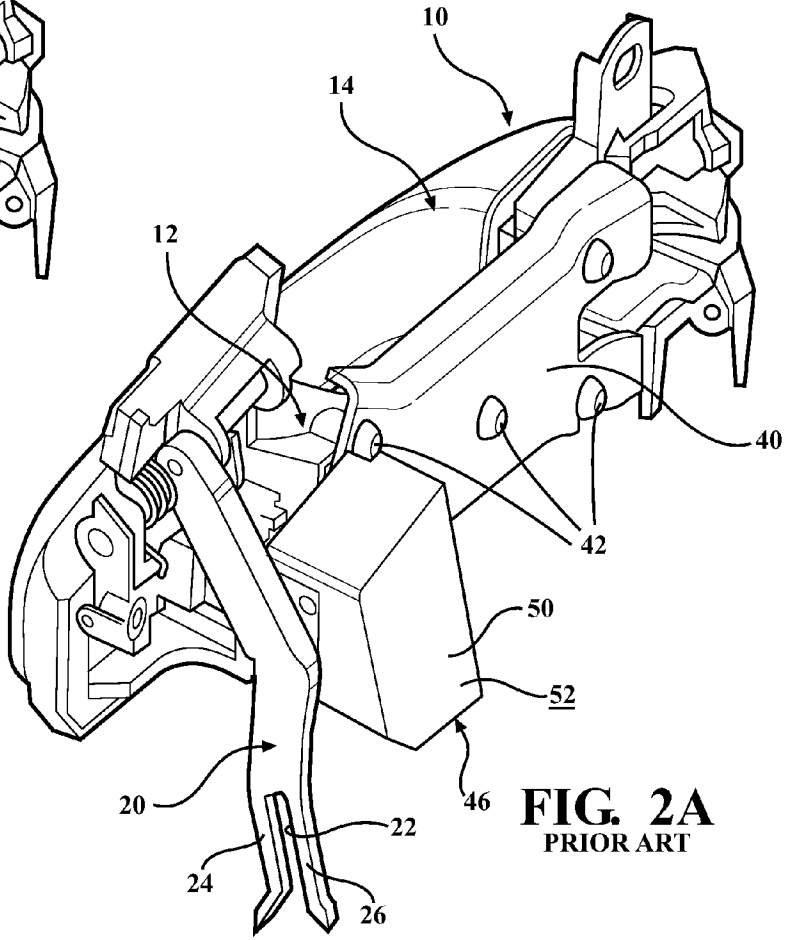
FIG. 2A PRIOR ART
FIG. 2A is a perspective view of the prior art door handle assembly shown in FIG. 1, additionally showing a prior art door lock assembly actuation prevention apparatus implemented with a plate and a prior art spacer.
Figure 1:
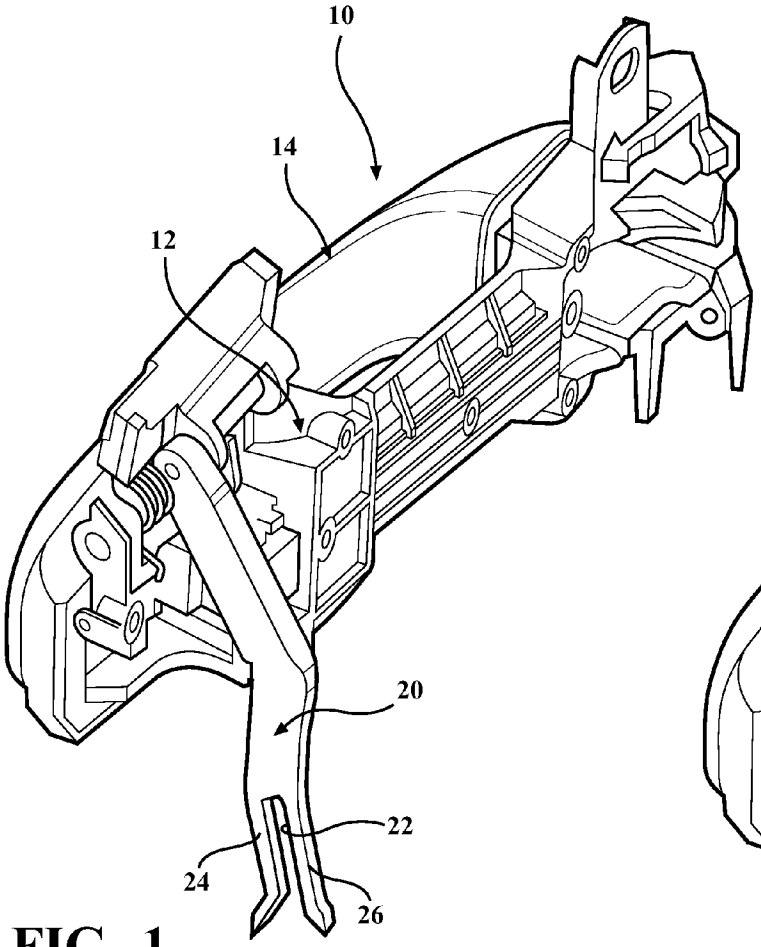
FIG. 1 PRIOR ART
FIG. 1 is a perspective view of a prior art door handle assembly for a vehicle door with a handle frame and a handle, showing a fork coupled to the handle for movement therewith to trigger actuation and unlatching of a door lock assembly.
Figure 5:
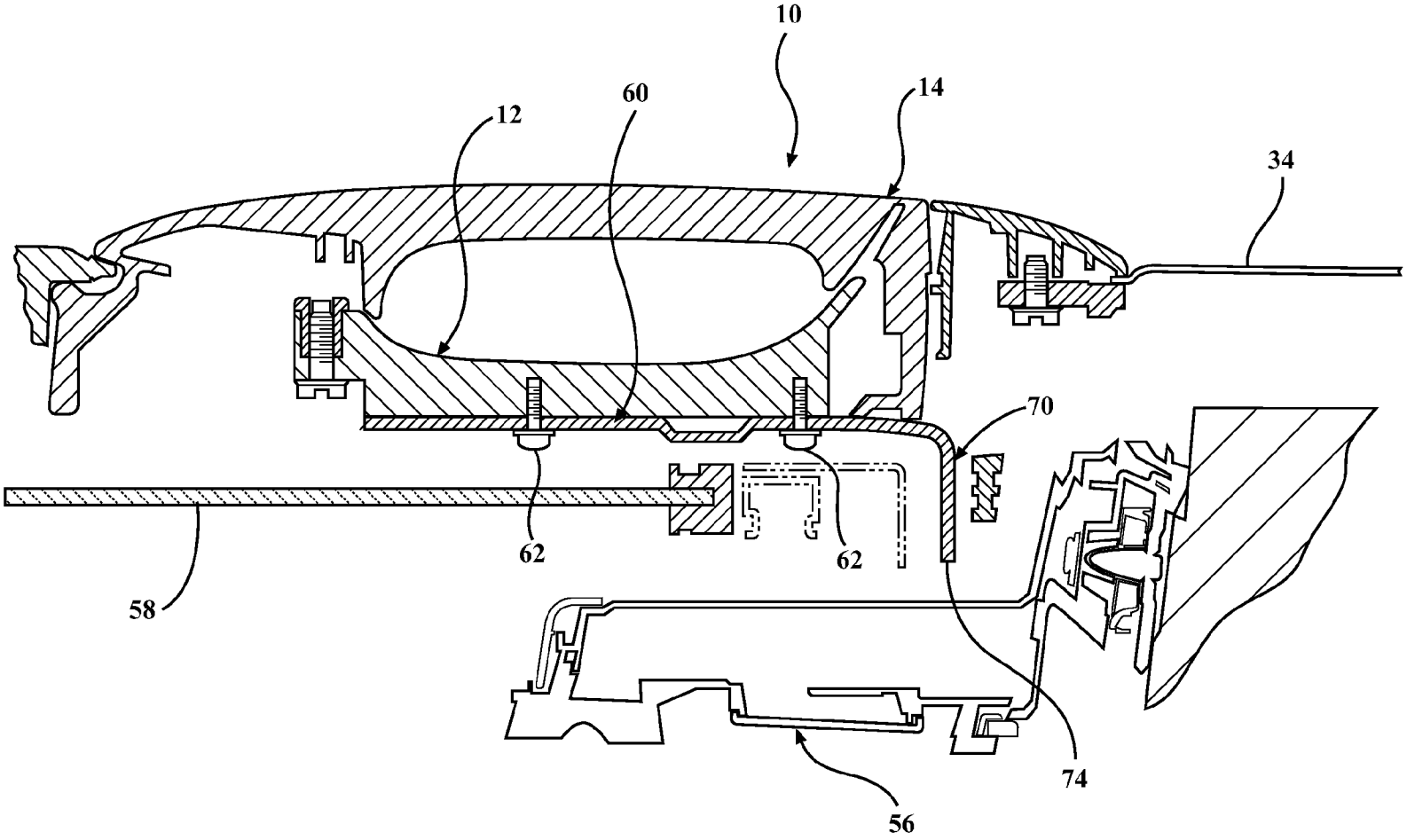
FIG. 5 is a longitudinal cross-sectional view of a vehicle door, showing a door handle assembly and one aspect of a door lock assembly actuation prevention apparatus with a plate carrying a flange.

Referring now to the drawing and to FIGS. 1, 2A, and 2B, there is depicted a prior art door handle assembly 10 which is mountable in a vehicle door as generally shown in FIG. 5. The door handle assembly 10 includes a handle frame 12 that supports a movable handle 14. The handle 14 is mounted for movement from a first stationary position to a second position generally exteriorly of the vehicle door in which the door handle assembly 10 is mounted. When in the second position, the handle 14 activates a door lock assembly mounted within the vehicle door to actuate and unlatch the door lock assembly and allow a user to pull the vehicle door open. The handle 14 may be a pivotal handle that is pivotally mounted with respect to the handle frame 12 for movement about one longitudinal end, or for movement about an entire upper edge. By way of example, FIGS. 1 and 2A depict a handle 14 pivotally mounted to the handle frame 12 for movement about one longitudinal end.

A link or fork 20 is pivotally coupled to the handle 14 for movement with movement of the handle 14. The fork 20 moves in a generally vertical up and down direction despite lateral pivotal movement of the handle 14. The fork 20 includes an open-ended slot 22 at a lower end formed between two spaced legs 24 and 26. As described hereafter, the fork 20 engages an actuator pin 30, shown in FIGS. 4A, 4B and 8, and moves the actuator pin 30 from a first position shown in FIG. 4A corresponding to the door lock assembly being latched and the vehicle door being latched in a closed position, to a second position shown in FIGS. 4B and 8, causing the door lock assembly to actuate and unlatch thereby unlatching the vehicle door and allowing the vehicle door to be moved to an open position relative to the vehicle.

Figure 8:
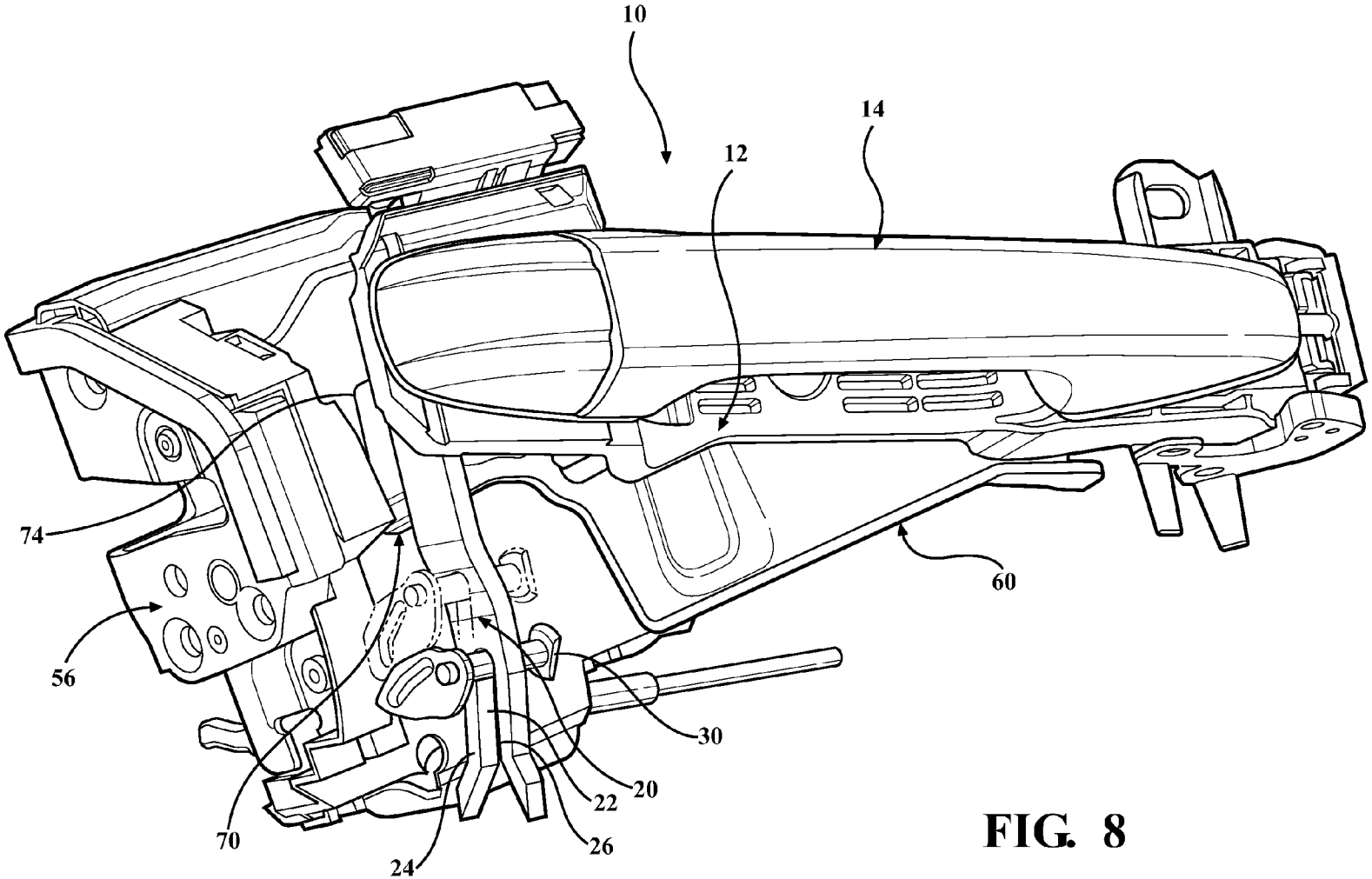
FIG. 8 is a right side perspective view of the door handle assembly, the door lock assembly and the door lock assembly actuation prevention apparatus shown in FIG. 7.

In certain situations, a lateral force may be exerted on an outer door panel 34, such as from a side impact collision with another object. This lateral force, shown by reference number 32 in FIG. 4A, if exerted at the appropriate height of the vehicle door, can bend the outer door panel 34 inward, as shown in FIG. 4A, a sufficient amount so that the outer door panel 34 strikes the fork 20. As seen in FIG. 8, a resulting lateral force acting on the fork 20 between the actuator pin 30 and the handle frame 12 may cause sufficient movement of the fork 20 to move the actuator pin 30 to the second position, actuating and unlatching the door lock assembly. This lateral force acting on the fork 20 causes the fork 20 to move toward its second position, shown in FIG. 4B, even though the handle 14 has not been laterally pivotally moved, and cause activation of the actuator pin 30 resulting in an unintentional actuation and unlatching of the door lock assembly and a potential opening of the vehicle door.

FIGS. 2A and 2B depict a prior art attempt to prevent inadvertent door lock assembly actuation and unlatching under a sideways or lateral force exerted on the vehicle door at its outer door panel 34. In this prior art configuration, a steel plate 40 is coupled by fasteners 42 to the handle frame 12. The plate 40 not only adds strength to the handle frame 12 but also provides a mounting platform for a spacer 46 in the form of a polymer resin molded block that is attached to one end of the plate 40 by fasteners, adhesive, etc. The spacer 46 includes a flange portion 48 which is fixed to the plate 40 and an enlarged three-dimensional, honey combed block portion 50. The block portion 50 extends away from the plate 40 toward the door lock assembly mounted within the vehicle door between the outer door panel 34 and an inner door panel. The projection or length of the block 50 away from the plate 40 is selected so that an outer surface 52 of the block 50 engages the door lock assembly as the entire door handle assembly 10 moves laterally inward under a lateral force exerted on the outer door panel 34. Engagement of the surface 52 of the block 50 with the door lock assembly prevents further movement of the door handle assembly 10 toward the door lock assembly and prevents sufficient movement of the fork 20 in a downward direction which would cause unintended movement of the actuator pin 30 to the second position in which the door lock assembly would be actuated and unlatched and the vehicle door would be unlatched and could be opened.

Figure 3:
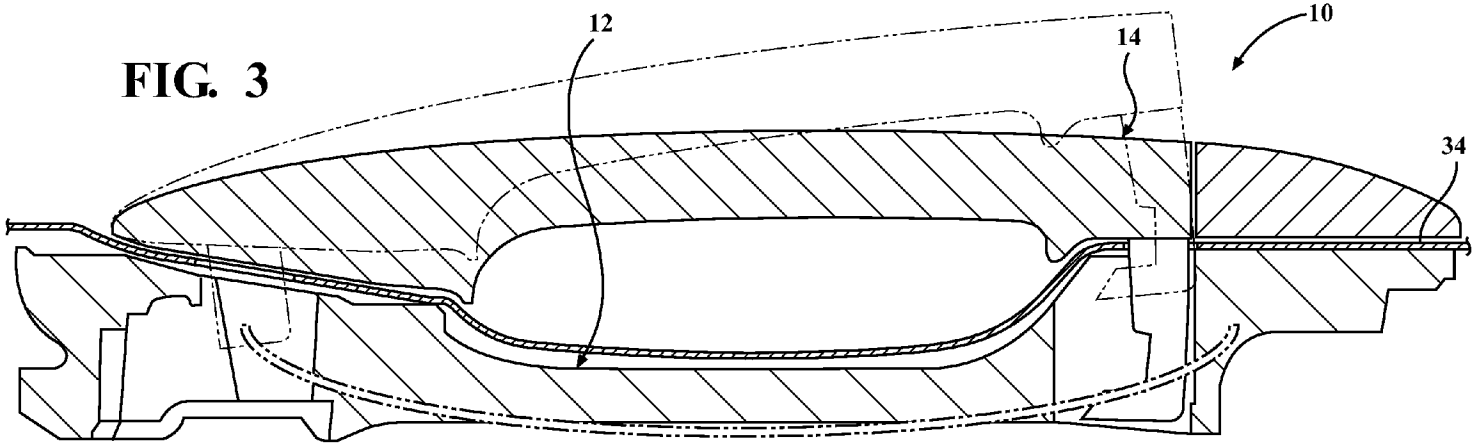
FIG. 3 is a longitudinal cross-sectional view of a vehicle door showing handle frame deformation under a lateral force resulting from a side impact collision which triggers actuation and unlatching of a door lock assembly via movement of the fork.
Figure 6:
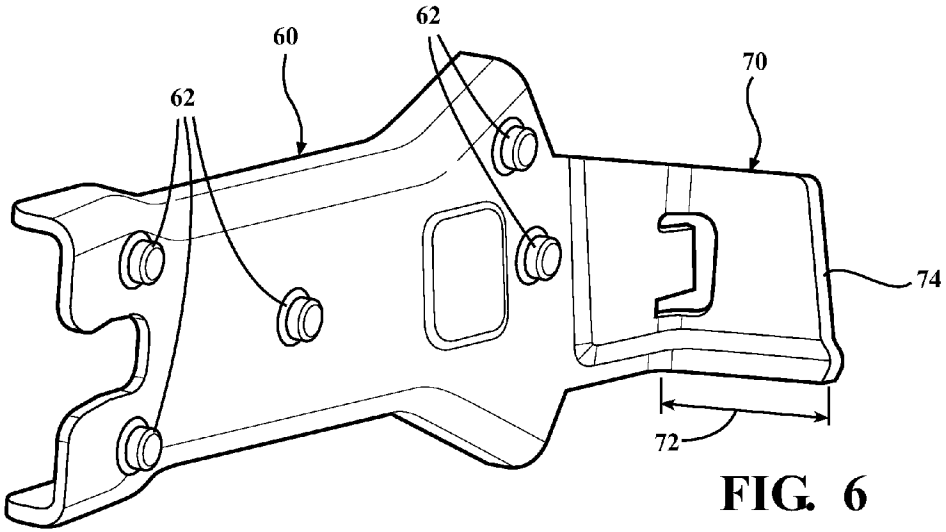
FIG. 6 is a perspective view of the door lock assembly actuation prevention apparatus shown in FIG. 5.

FIG. 3 depicts the handle frame 12 moving inward and bowing under a lateral force exerted on the door handle assembly 10. This inward movement of the handle frame 12 can also cause engagement of the door handle assembly 10 with the door lock assembly resulting in unintentional actuation and unlatching of the door lock assembly.

In certain vehicle door configurations, space constraints restrict the amount of open space between the door handle assembly 10, a door lock assembly 56, and a rear portion of the vehicle door glass 58, as shown in FIG. 5. This limited space availability prevents the use of the prior art spacer 46.

A solution to this problem can be found in FIGS. 5-9 in which a flange 70 in the form of a thin cross-section flange angularly extending from a plate 60 is carried on the plate 60. The plate 60 is coupled by fasteners 62 to the handle frame 12. The flange 70 can, in one aspect, be integrally formed as a bent end portion of the plate 60 and can have the same thin cross-section thickness as the plate 60. Alternately, the flange 70 can be a separate component that is fixedly secured to the plate 60 by fasteners, adhesive, or other attachment means.

The length 72 of the flange 70, which defines the projection or distance that an outer end 74 of the flange 70 extends from a major surface of the plate 60, is chosen so as to limit movement of the plate 60 upon lateral forces exerted on the vehicle door at its outer door panel 34, such as during a side impact collision, and the attached handle frame 12 in a direction toward the door lock assembly 56 so as to prevent sufficient movement of the fork 20 which would move the actuator pin 30 toward the second position a sufficient distance to actuate and unlatch the door lock assembly 56. As shown in FIG. 5, the outer end 74 of the flange 70 can be initially spaced from the door lock assembly 56 in a normal closed state of the vehicle door. Alternately, the outer end 74 of the flange 70 can be in contact with or spaced by only a slight distance from the door lock assembly 56.

Figure 7:
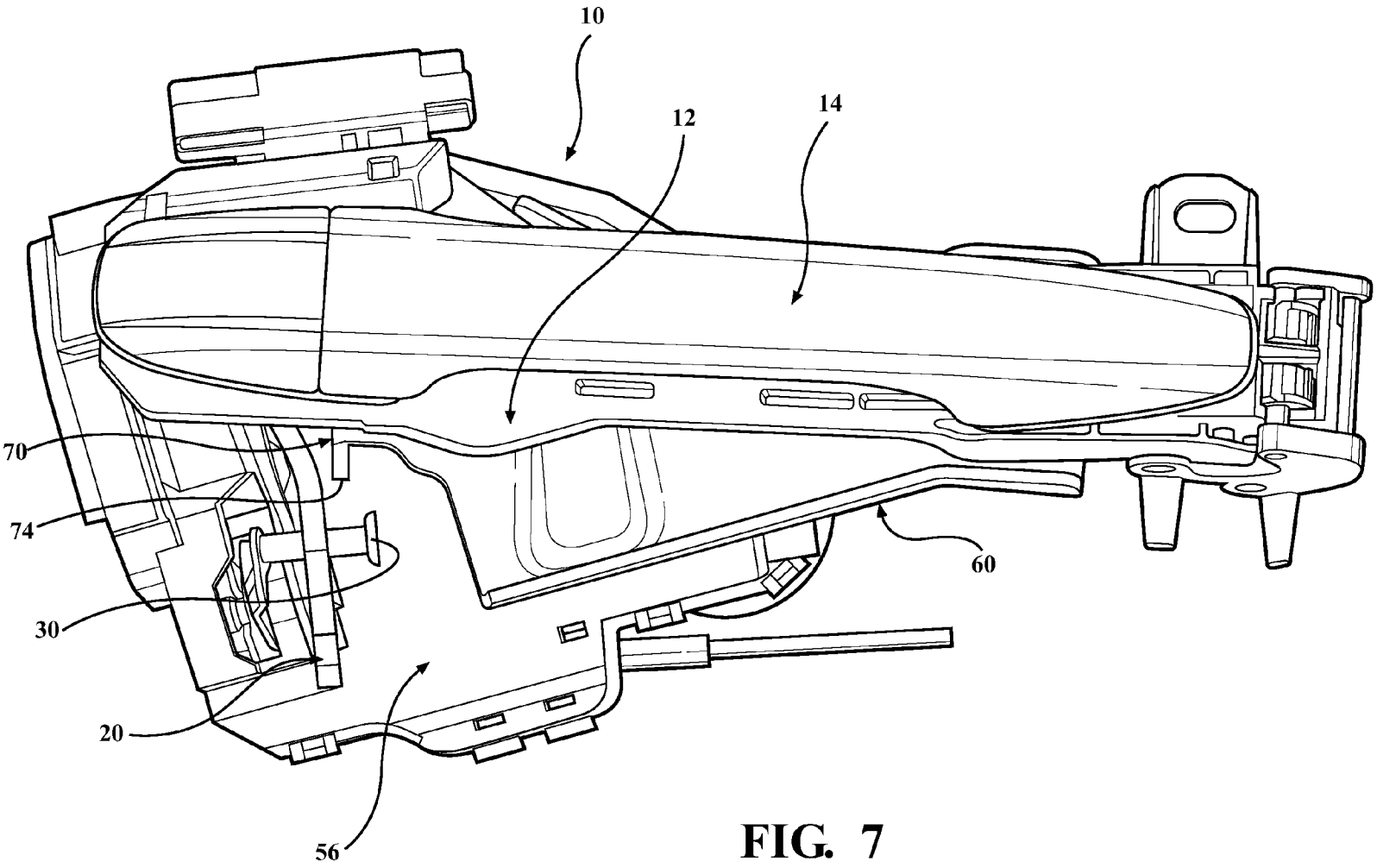
FIG. 7 is an exterior right side elevation view of a door handle assembly for a vehicle door with a handle frame and a handle, and of a door lock assembly, showing the door lock assembly actuation prevention apparatus of FIGS. 5 and 6 mounted between the door lock assembly and the handle.
Figure 9:
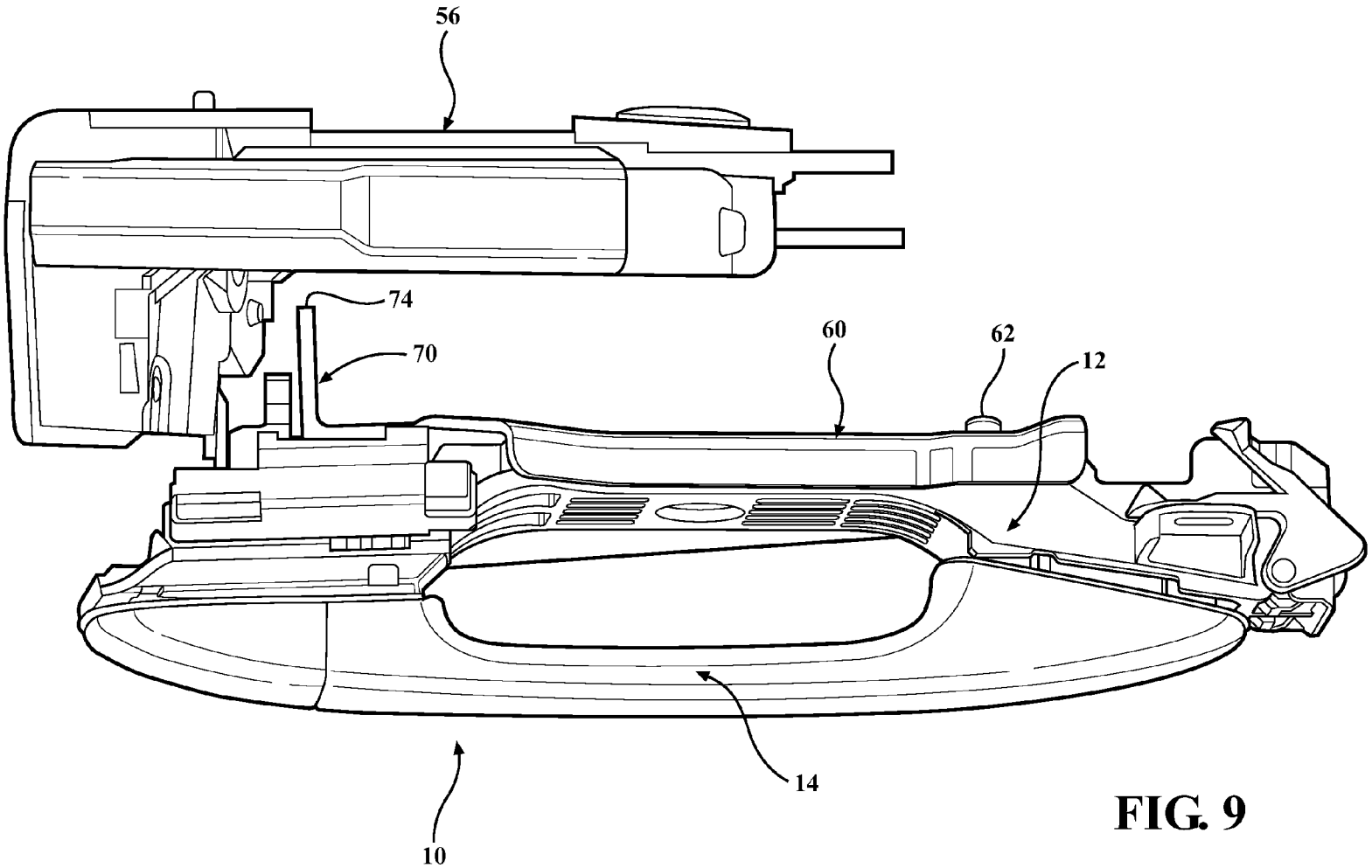
FIG. 9 is a plan view of the door handle assembly, the door lock assembly and the door look assembly actuation prevention apparatus shown in FIGS. 7 and 8.

The mounting of the flange 70 and the plate 60 on the handle frame 12 of the door handle assembly 10 in its spaced relationship from the door lock assembly 56 can be seen in FIGS. 7-9.

In one aspect, the thin cross-section flange 70 carried on the plate 60 forms part of a door lock assembly actuation prevention apparatus since the projection or length 72 of the flange 70 from the plate 60 is chosen to minimize the amount of inward movement of the door handle assembly 10 toward the door lock assembly 56 when a sideways impact force is exerted on the vehicle door at its outer door panel 34 causing the door handle assembly 10 to move in an inward direction toward the center of the vehicle. During such movement, the outer end 74 of the flange 70 will engage the door lock assembly 56 and stop further lateral inward movement of the door handle assembly 10. This stoppage of inward movement of the door handle assembly 10 by the engagement of the outer end 74 of the flange 70 with the door lock assembly 56 occurs before the fork 20 movably coupled to the handle 14 has moved a sufficient distance downward to move the actuator pin 30 to the second position fully actuating and unlatching the door lock assembly 56. In this manner, the flange 70 prevents accidental actuation and unlatching of the door lock assembly 56 during a side impact collision on the vehicle door.

In another aspect, the flange 70 carried on the plate 60 forms part of the door handle assembly 10 mountable in a vehicle door. The outer end 74 of the flange 70 extends from the plate 60 mounted on the handle frame 12 a sufficient distance toward the door lock assembly 56 mounted within the interior of the vehicle door to limit the maximum amount of lateral or inward movement of the door handle assembly 10 toward the door lock assembly 56. This maximum amount of inward movement distance is selected through the length 72 of the flange 70 from the plate 60 to prevent movement of the fork 20 coupled to the door handle assembly 10 a sufficient distance so that the door lock assembly 56 is not stroked or actuated or is stroked or actuated insufficiently to actuate and unlatch the door lock assembly 56.

The flange 70 carried on the plate 60 also forms part of a vehicle door where the flange 70 and the plate 60 are mounted on the handle frame 12 which is part of the door handle assembly 10 mounted in the vehicle door and laterally spaced from the door lock assembly 56 also mounted within the vehicle door. The fork 20 movably coupled to the handle 14 engages the actuator pin 30 and is capable of moving the actuator pin 30 to a second position causing an unlatching of the door lock assembly 56 when the handle 14 is pivoted to an outward position relative to the vehicle door to enable the vehicle door to be opened. The flange 70 carried on the plate 60 attached to the handle frame 12 limits lateral inward movement of the handle 14 under a lateral force exerted on the vehicle door, such as during a side impact collision, to prevent the door lock assembly 56 from being actuated and unlatched.

What is claimed is:

1. A vehicle door comprising:

an outer door panel joined to an inner door panel;

a door handle assembly mounted in the outer door panel, the door handle assembly including handle frame and a handle supported by the handle frame for movement relative to the handle frame;

a door lock assembly mounted between the outer door panel and the inner door panel;

an actuator pin located between the outer door panel and the inner door panel, the actuator pin coupled to the door lock assembly, and movable from a first position corresponding to a latched condition of the door lock assembly and a second position in which the actuator pin unlatches the door lock assembly to allow opening of the vehicle door;

a fork located between the outer door panel and the inner door panel in a space between the door handle assembly and the door lock assembly, the fork coupled with the handle for movement with movement of the handle relative to the handle frame, and with its movement, engageable with the actuator pin to move the actuator pin to its second position; and a plate coupled to the handle frame, the plate having a major surface across the handle frame, and carrying an upright flange with the same cross-sectional thickness as the major surface projecting from the major surface at an angle into the space between the door handle assembly and the door lock assembly to limit relative movement between the handle frame and the door lock assembly under lateral forces exerted on the outer panel to prevent the fork from moving the actuator pin to its second position, and thereby prevent the door lock assembly from unlatching.

2. The vehicle door of claim 1 wherein:

the flange is integrally formed with the plate.

3. The vehicle door of claim 1 wherein:

the flange extends substantially perpendicularly from the handle frame.

4. The vehicle door of claim 1 wherein:

the flange is integrally formed as a bent end portion of the plate.

5. The vehicle door of claim 1 wherein:

the flange is substantially two-dimensional.

6. The vehicle door of claim 1 wherein:

the flange has a length and an outer end, and projects into the space between the door handle assembly and the door lock assembly such that the outer end of the flange is spaced from the door lock assembly.

7. The vehicle door of claim 1 wherein:

the flange has a length and an outer end, and projects into the space between the door handle assembly and the door lock assembly such that the outer end of the flange contacts the door lock assembly.

8. The vehicle door of claim 1 wherein:

the flange projects into the space between the door handle assembly and the door lock assembly in flanking relationship with the fork.

9. The vehicle door of claim 1 further comprising:

vehicle door glass located between the outer door panel and the inner door panel, the vehicle door glass having an upright edge in a space between the handle frame and the door lock assembly, wherein the flange projects into the space between the door handle assembly and the door lock assembly in flanking relationship with the upright edge of the vehicle door glass.

* * * * *